US005499774A

United States Patent [19]

Novak et al.

[11] Patent Number: 5,499,774

[45] Date of Patent: Mar. 19, 1996

[54] WIRE PULL-IN APPARATUS

[75] Inventors: Heinrich Novak, Graz; Herbert Berthold, Deutschlandsberg; Gerhard Barta; Hans-Peter Pichler, both of Graz, all of Austria

[73] Assignees: MAG Maschinen; Apparatebau Gellschaft mbh, both of Graz, Austria

[21] Appl. No.: 37,622

[22] Filed: Mar. 25, 1993

[30] Foreign Application Priority Data

Mar. 31, 1992 [EP] European Pat. Off. ..... 92105550

[51] Int. Cl.[6] ..... B65H 51/00; B65H 51/08

[52] U.S. Cl. ..... 242/47.03; 242/47.08

[58] Field of Search ..... 242/47.03, 47.01, 242/47.08, 47.09, 47.1, 47.11, 47.12, 47.13

[56] References Cited

U.S. PATENT DOCUMENTS

| | | | |
|---|---|---|---|
| 894,593 | 7/1908 | Callan | 242/47.03 |
| 2,232,500 | 2/1941 | Weaver | 242/47.03 |
| 2,249,711 | 7/1941 | Knebusch | 242/47.03 |
| 2,350,182 | 5/1944 | Neff | 242/47.03 |
| 2,525,760 | 10/1950 | Barker | 242/47.03 |
| 2,545,015 | 3/1951 | Barker | 242/47.03 |
| 2,771,180 | 11/1956 | Barker | 242/47.03 |
| 2,794,542 | 6/1957 | Vandenburgh et al. | 242/47.03 |
| 3,460,361 | 8/1969 | Hashe, Jr. | 242/364.2 X |
| 3,462,979 | 8/1969 | Ziegler | 242/364.2 X |
| 4,090,675 | 5/1978 | Betta | 242/47.01 X |
| 4,383,655 | 5/1983 | Ahrendt et al. | 242/47.08 X |

*Primary Examiner*—Michael R. Mansen
*Attorney, Agent, or Firm*—Dennis T. Griggs

[57] ABSTRACT

In a wire pull-in apparatus in which a wire to be coated passes repeatedly through individual work units of a wire enameling facility, band rollers (5, 6, 7) are coaxially mounted before the faces of wire guide roller blocks (2, 3, 4) about which the wire to be coated runs, with an endless band (1) bearing a fastening portion (8) and being guided in untwistable fashion about the band rollers. The wire shifting rollers (9) and (10) are located before each wire guide roller block (2) and (3) and are axially parallel thereto. The wire to be pulled in is fixed on the fastening portion (8) and is placed about the wire guide roller blocks (2, 3, 4) by rotation of the endless band (1). After each full rotation of the endless band (1), each new wire loop placed about the wire guide blocks is shifted laterally a certain distance on the wire guide blocks by rotation or axial shifting of the wire shifting rollers (9, 11) so that room is always made for the placing of a further wire loop.

6 Claims, 6 Drawing Sheets

WIRE PULL-IN APPARATUS

FIELD OF THE INVENTION

The present invention relates to a wire pull-in apparatus of the kind used in wire enameling facilities wherein wire removed from a wind-off means is guided repeatedly about spaced, axially parallel wire guide roller blocks, with the wire running about these wire guide roller blocks and passing repeatedly through the processing units of the wire enameling facility and being thereafter removed from the wire guide roller blocks.

BACKGROUND OF THE INVENTION

A conventional wire pull-in apparatus uses a traversing bar for placing wires to be coated on the wire guide roller blocks of a wire enameling facility. The traversing bar is mounted on a band running about the roller blocks and carries a slide that is displaceable perpendicular to the direction of motion of the traversing bar. The traversing bar is shifted by a mechanical switch assembly after each full rotation of the traversing bar by the distance that is necessary for placing a wire or several wires fastened to the slide in the free groove or grooves of the roller blocks during the subsequent rotation of the traversing bar.

SUMMARY OF THE INVENTION

The present invention provides an improved wire pull-in apparatus of the kind discussed above so that the apparatus in particular requires less maintenance, has an improved service life and requires less manufacturing effort compared to conventional wire pull-in apparatus.

In accordance with the invention, the wire pull-in apparatus includes wire guide roller blocks whereby at least one deflection roller is mounted coaxially with the wire guide roller blocks before at least one of their respective faces. A wire guide means is guided about the deflection roller with a wire holding means for one end of the wire being provided thereon. Furthermore, a wire shifting means is provided in axially parallel fashion in front of at least one of the wire guide roller blocks, regarded in the running direction of the wire.

In a preferred embodiment, the deflection rollers are formed by band rollers and the wire guide means by an endless band so that the endless band is guided in untwistable fashion. In an advantageous development of the invention the fastening portion for the wire holding means is disposed on the outside of the endless band. Furthermore, the fastening portion can be developed so as to have a laterally projecting fastening means for depositing the wire on the wire guide roller block in the position of the last passage during a rotation of the band.

According to a further embodiment of the invention, the band roller located in front of a driven wire guide roller block which is adapted to be coupled therewith. In a further embodiment, the wire guide roller block is characterized by parallel guide grooves spaced a certain equal distance apart on the periphery thereof and perpendicular to the axial direction.

According to another aspect of the invention, the wire shifting means are designed as eccentrically mounted single-flight threaded spindles having a pitch corresponding to the distance between two guide grooves on the wire guide blocks. In a further embodiment, the wire guide roller blocks have smooth peripheral surfaces while the wire shifting means are formed by wire shifting rollers. The wire shifting rollers are concentrically mounted and axially displaceable. Moreover, the wire shifting rollers are characterized by parallel guide grooves spaced a certain equal distance apart on the periphery thereof and perpendicular to the axial direction. Furthermore, the wire shifting means can each comprise a concentrically mounted core with parallel guide grooves spaced certain equal distances apart on the periphery thereof perpendicular to the axial direction and a half-open threaded hollow spindle concentrically rotatable about this core. The pitch of the threaded hollow spindle is advantageously equivalent to twice the distance between two guide grooves of the core.

ADVANTAGES OF THE INVENTION

The manufacturing effort for the inventive wire pull-in apparatus is reduced over known wire pull-in apparatus since relatively simple components are used that are furthermore inexpensive to produce.

The higher wear occurring in known wire pull-in apparatus due to their many sliding guide means and their resulting susceptibility to trouble can also be almost completely eliminated by the present invention.

BRIEF DESCRIPTION OF THE DRAWINGS

The invention shall be explained in more detail in the following description of three exemplary embodiments taken with reference to FIGS. 1 to 9, in which.

DETAILED DESCRIPTION OF THE PREFERRED EMBODIMENT

Figure 1:
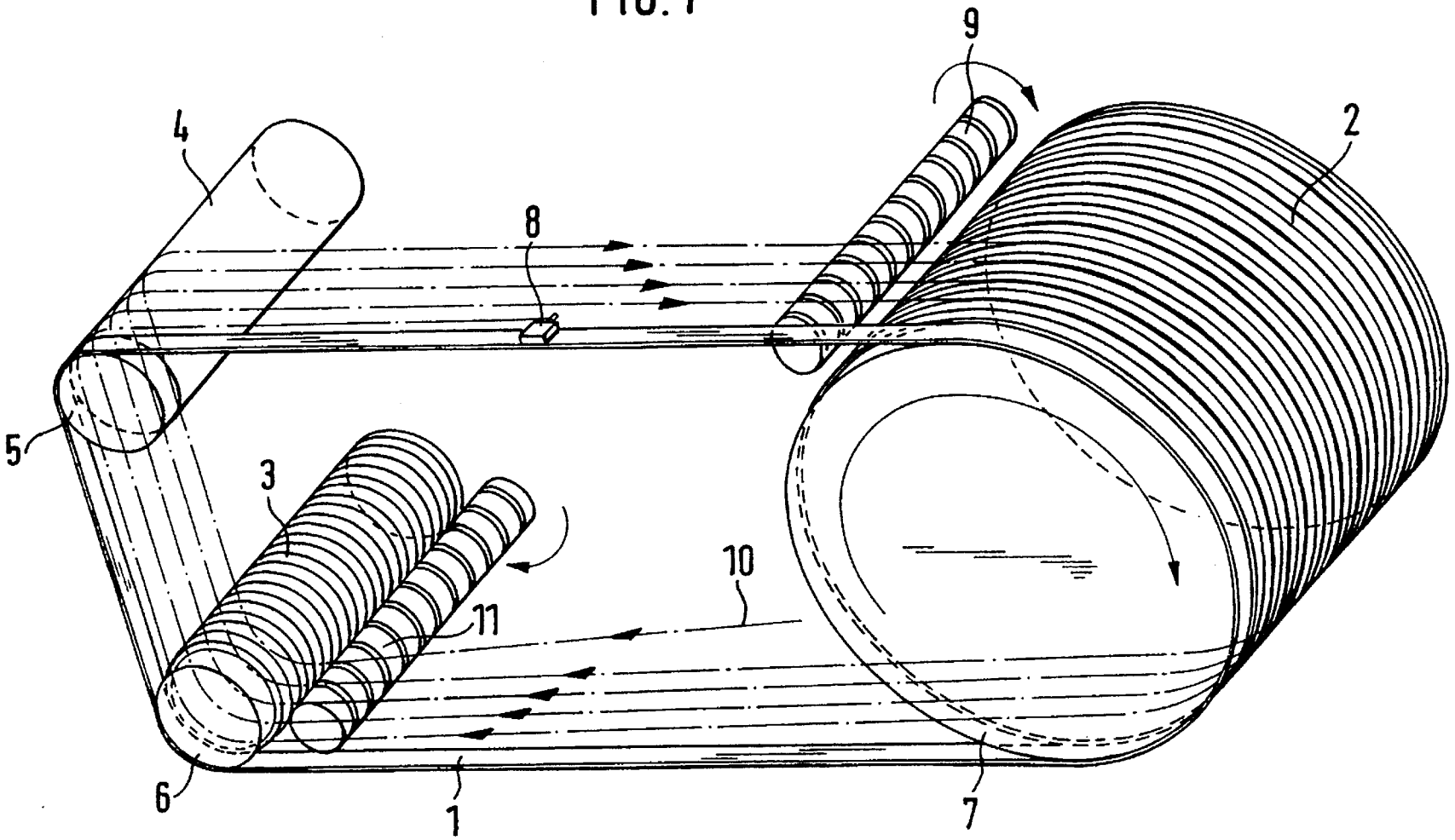
FIG. 1 shows a perspective view of a wire pull-in apparatus.
Figure 2:
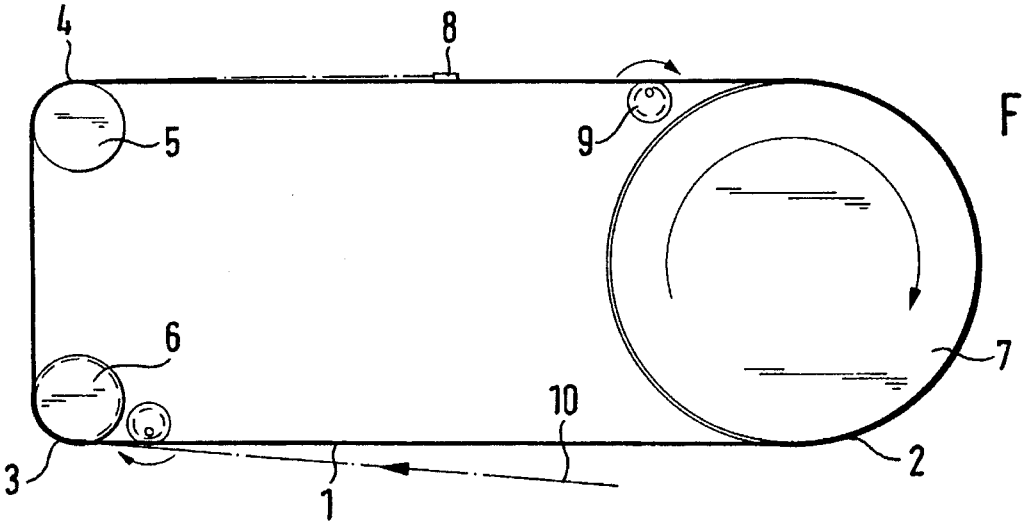
FIG. 2 shows a side view according to FIG. 1.
Figure 3:
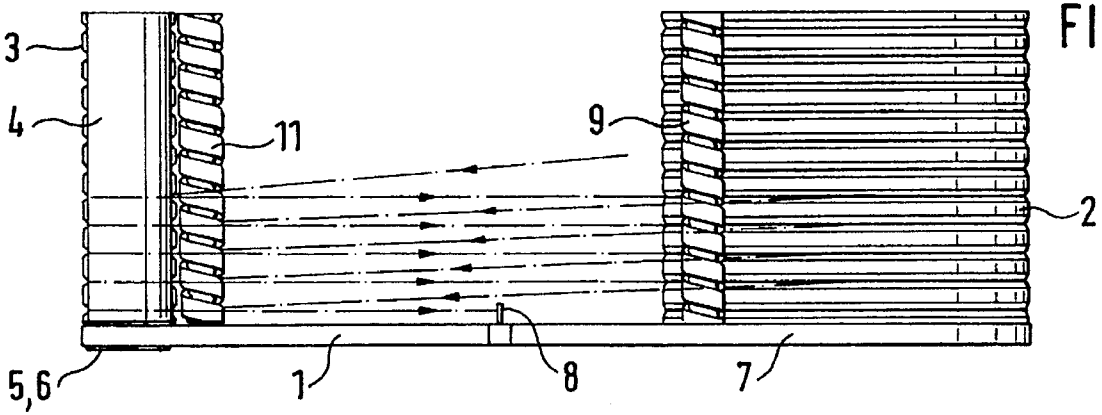
FIG. 3 shows a top view according to FIG. 1.

FIG. 1 to FIG. 3 show a first exemplary embodiment in a perspective view.

The wire pull-in apparatus of the first exemplary embodiment includes an endless and twist-proof band 1, a wire holder 8 and a pair of single-flight threaded spindles 9, 11.

The twist-proof band 1 is guided over deflection rollers 5, 6, 7 which are disposed coaxially with respect to wire deflection roller blocks 2, 3, 4 and arranged behind the last wire passage means as viewed in the axial direction. The wire deflection roller blocks 2, 3, 4 are driven via the deflection rollers 7, 6 and 5, respectively. The wire holder 8 is constructed such that a wire fixed thereto is positioned into the last guide grooves of the wire deflection roller blocks 2, 3 during one band revolution. The single-flight threaded spindles 9, 11 are disposed immediately in front of the wire guide roller blocks 2, 3 in parallel alignment therewith and are supported for eccentrically pivoting movement. The grooves on the spindles have a pitch corresponding to the distance between two guide grooves at the wire deflection roller blocks 2, 3.

For a wire 10 to be placed about wire guide roller blocks 2, 3 and 4, the beginning of the wire is fixed on a fastening portion 8. The fastening portion 8 is firmly connected by an endless band i that is guided over band rollers 5, 6 and 7 mounted coaxially with wire guide roller blocks 2, 3 and 4 before the faces thereof. The band roller 7 is adapted to be coupled to the driven wire guide roller block 2 so that it can be driven thereby.

In the starting position, the fastening portion 8 is located immediately after wire guide roller block 5, with respect to the running direction of the wire. Eccentrically rotatable wire shifting rollers 9, 11 are designed as threaded spindles and have a thread pitch corresponding to the distance between two guide grooves on wire guide blocks 2 and 3. The shifting rollers 9, 11 are rotated so that the wire to be pulled in does not touch the spindles.

After the leading end of the wire is secured to the fastening portion 8, an endless band 1 is set rotating by switching on the driven wire guide roller block 2 and the band roller 7 coupled thereto, so that the band 1 places the wire it is trailing in the last grooves of wire guide blocks 2 and 3. After one full rotation of endless band 1, eccentrically mounted wire shifting rollers 9 and 11 (designed as threaded spindles) have performed one full rotation, so that the wire traveling in the guide grooves of wire guide roller blocks 2 and 3 is lifted out of the last grooves of wire guide blocks 2 and 3 through the eccentric motion. The wire is then shifted laterally by one groove interval through the thread pitch and then lowered again so that it changes from the last guide grooves to those located therebefore. This makes the last guide grooves on wire guide roller blocks 2 and 3 free for further wire to be placed thereon, and the above-described process may repeat itself depending on the desired number of passages.

In the starting position, the wire holder 8 is arranged, as viewed in the direction of wire transport, directly following the wire deflection roller block 2. The threaded spindles 9, 11 are supported in eccentrically pivotable manner such that the wire to be pulled in does not touch the spindles. The spindles 9, 11 are rotated by drive motors. After the wire end is fixed to the wire holder 8, the band 1 is put into rotation by switching on the driven wire deflector roller block 2 and the deflection roller 7 coupled thereto, whereby the latter positions the wire pulled behind it in the respectively last grooves of the wire deflection roller blocks 2, 3. After a full revolution of the band 1, the wire connector 8 activates a contactless proximity switch mounted below the driven wire deflector roller block 2, whereby drive motors coupled to the threaded spindles 9, 11 are made rotate.

Due to the eccentric movement of the eccentrically supported spindles 9, 11, the wire running in the guide grooves of the wire deflection roller blocks 2, 3 is caught by thread grooves and is axially shifted by the pitch in such manner that the wire is shifted from the guide grooves in the wire deflection roller blocks 2, 3 to those positioned in front thereof. After each full revolution of the threaded spindles, contact lugs mounted on the threaded spindles 9, 11 open and disconnect electrical power from the drive motors. Thereby, the last guide grooves at the wire deflection roller blocks 2, 3 become free for the next passage and the operation described above can be repeated in accordance with the desired number of passages.

Figure 4:
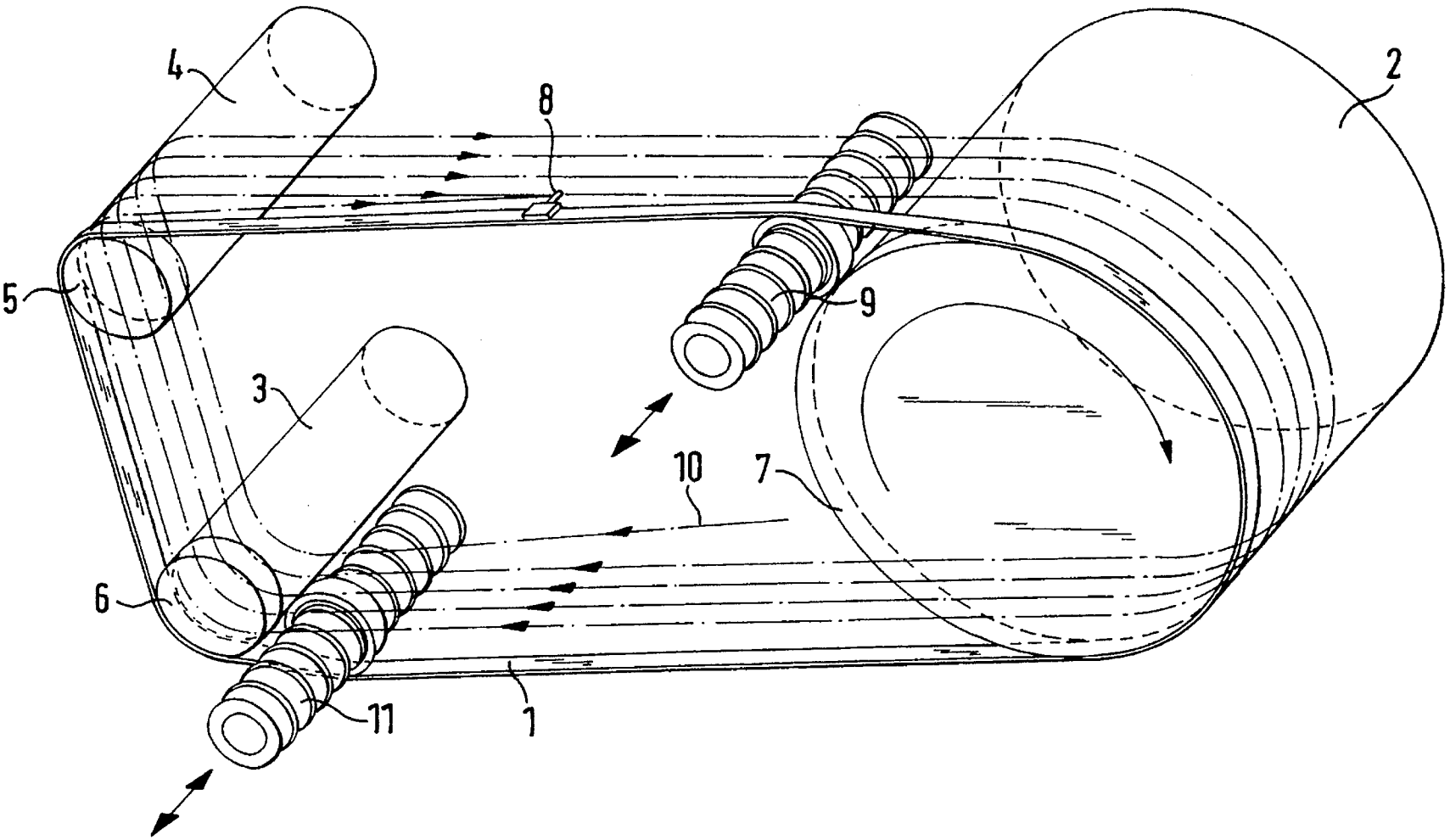
FIG. 4 shows a second embodiment example in a perspective view.
Figure 5:
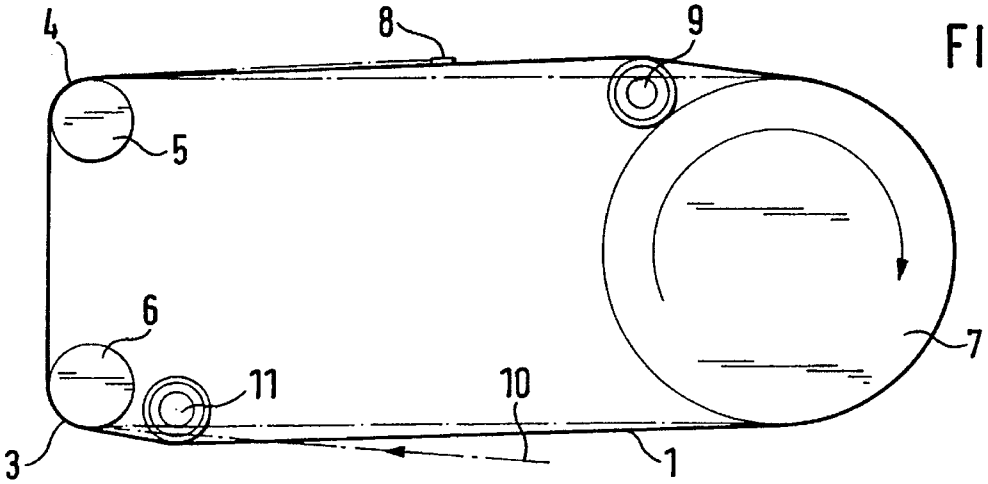
FIG. 5 shows a side view according to FIG. 4.
Figure 6:
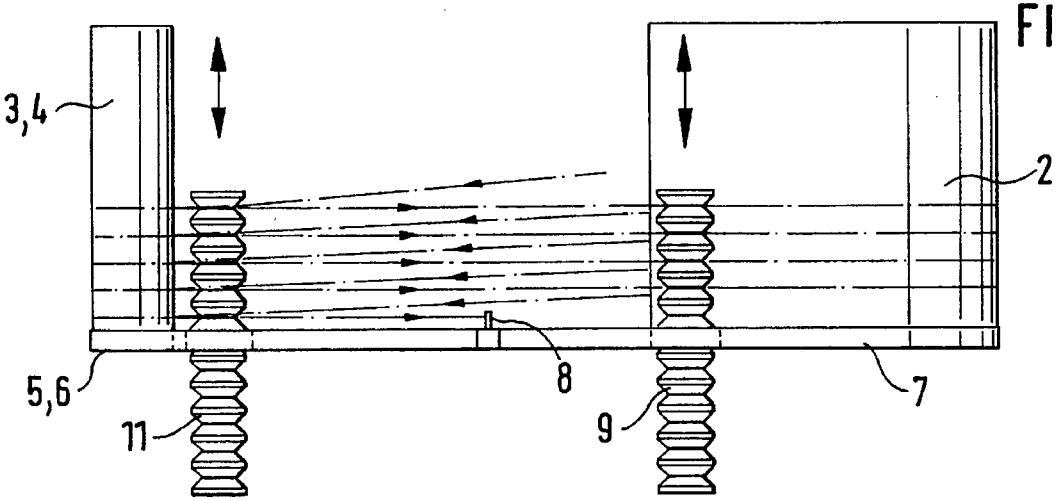
FIG. 6 shows a top view according to FIG. 4.

FIGS. 4 to 6 show a second embodiment example of the invention.

The wire pull-in apparatus includes an endless and twist-proof band 1 which is guided over deflection rollers 5, 6, 7 disposed coaxially with respect to the wire deflection roller blocks 2, 3, 4 and arranged behind the last wire passage means as viewed in the axial direction and which are driven by the deflection roller 7 which is coupled to the driven wire deflection roller block 2. A wire holder 8 holds the wire to the band and is oriented relative to the band such that the wire fixed thereto is positioned in the last passage at the wire deflection roller block during one band revolution. Wire guide roller blocks 9 are disposed immediately in front of the wire guide roller blocks 2, 3 and axially parallel therewith. The wire guide roller blocks are shiftable in the axial direction and have a guide groove distance corresponding to the wire enamelling plant. Contactless proximity switches scan the position of the wire guide roller blocks 9, 11 for controlling the axial shifting movement of the wire guide roller blocks 9, 11. Alternatively, the wire guide roller blocks may be shifted manually.

Wire guide roller blocks 2, 3 and 4 are designed here as cylindrical rollers with smooth peripheral surfaces. Wire shifting rollers 9 and 11 are disposed in axially parallel fashion in front of the wire guide roller blocks, regarded in the running direction of the wire. The shifting rollers are concentrically mounted and axially displaceable and bear parallel guide grooves on the periphery thereof perpendicular to the axial direction and are spaced apart by an equal distance determined by the requirements of the wire enameling facility.

In the starting position, the fastening portion 8 is again located immediately after the wire guide roller block 4, regarded in the running direction of the wire. Wire shifting rollers 9 and 11 are shifted fully outward axially at the beginning of the wire pull-in, so that the first guide grooves come to lie precisely under the wire fixed on the fastening portion 8. When the band 1 is set moving, driven by wire guide roller block 2 and band roller 7 coupled therewith, the fastening portion 8 trails the beginning of the wire fixed thereto, placing it about wire guide roller blocks 2, 3 and 4 and in the first guide grooves of wire shifting rollers 9 and 11. After each rotation of the band 1, the wire shifting rollers 9 and 11 are shifted inward by the distance corresponding to that between two guide grooves on wire shifting rollers 9 and 11.

Thus the wire is shifted axially by one groove interval on the wire guide roller blocks upon each rotation of the band, making the next free guide grooves of wire shifting rollers 9 and 11 available for a further wire passage. The described process may repeat itself in accordance with the desired number of passages.

Figure 7:
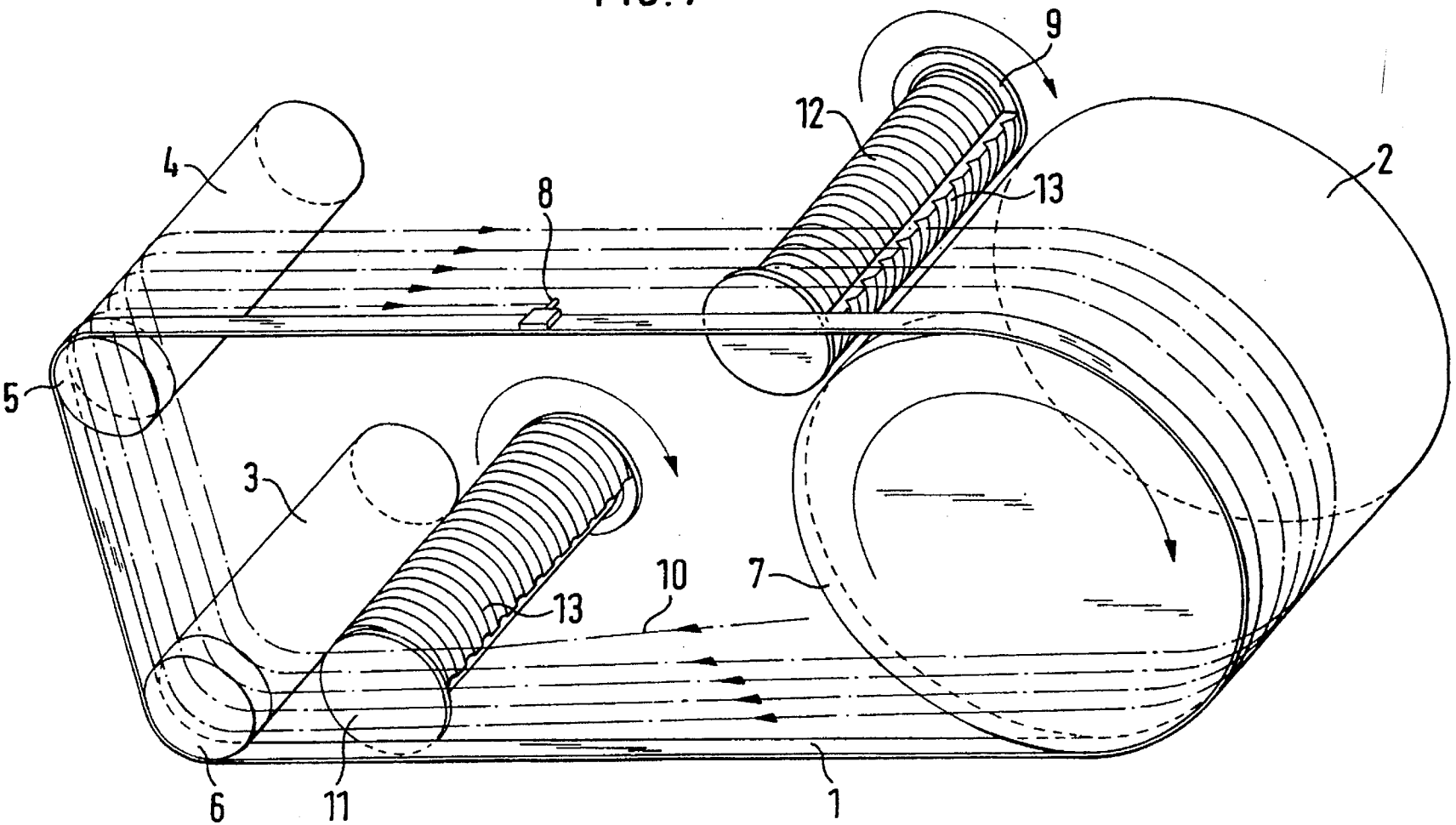
FIG. 7 shows a third embodiment example with a threaded hollow spindle in a perspective view.
Figure 8:
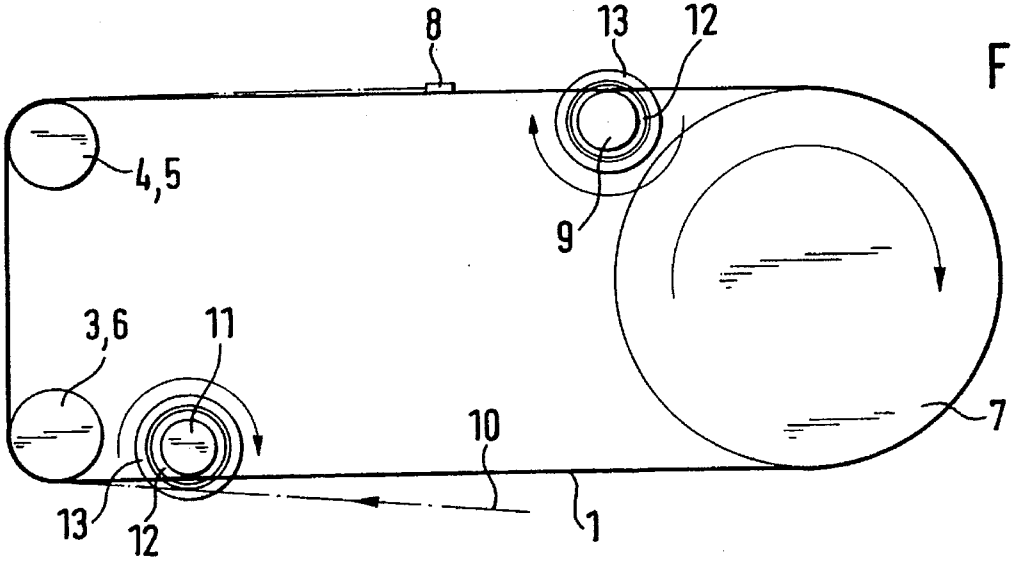
FIG. 8 shows a side view according to FIG. 7.
Figure 9:
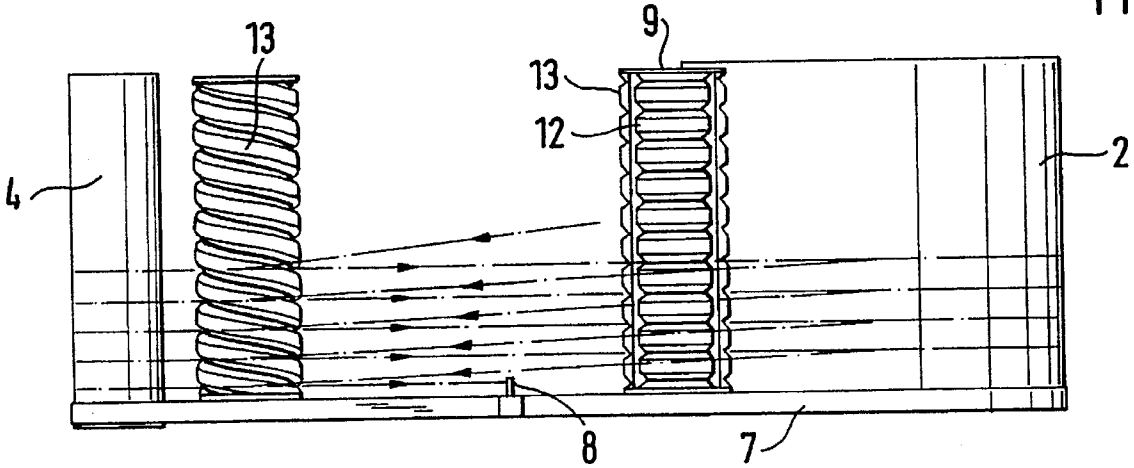
FIG. 9 shows a top view according to FIG. 7.

FIG. 7 to FIG. 9 show a third embodiment example.

In the starting position, the wire connector 8 is arranged, as viewed in direction of wire transport, directly following the wire deflection roller block 5. The axially shiftable wire guide roller blocks 9 are shifted manually or by drive motors such that each time only the first groove comes to lie in the position which corresponds to the last wire passage at the wire defection roller blocks 2, 3, 4. After the wire is fixed to the holder 8, the band 1 is put into rotation by switching on the driven wire deflector roller block 2 and the deflection roller 7 coupled thereto. The deflection roller 7 positions the wire pulled behind it in the first grooves of the wire guide roller blocks 9, 11 and of the wire deflection roller blocks 2, 3 in this position.

After a full revolution of the band 1, the wire holder 8 activates a contactless proximity switch mounted below the driven wire deflector roller block 2, whereupon the wire guide roller blocks 9, 11 are axially shifted by lifting spindle drives until contactless proximity switches arranged below the wire guide roller blocks 9, 11 are activated by the axial movement of the wire guide roller blocks 9, 11 and thus terminate the axial movement of the lifting spindle drive motors. The distance of axial movement corresponds to the distance between two guide grooves at the wire guide roller blocks 9, 11. The wire changes its position as viewed in the axial direction at the wire deflection roller blocks 2, 3, 4. By this arrangement, a free guide groove is again made available at the wire guide roller blocks 9, 11 and the position at the wire deflection roller blocks 2, 3 becomes free for the next wire passage, so that the operation described above can be repeated in accordance with the desired number of passages.

As in the second embodiment example, the wire guide roller blocks 2, 3 and 4 have smooth peripheral surfaces. The wire shifting rollers 9 and 11 each comprise a concentrically mounted core 12 with parallel guide grooves on the periphery thereof perpendicular to the axial direction and spaced apart by certain equal distances as determined by the wire enameling facility. As half-open threaded hollow spindle 13 is concentrically rotatable about this core 12 whose pitch corresponds to twice the distance between two guide grooves of core 12.

In the starting position, the fastening portion 8 is again located immediately after wire guide roller block 4, regarded in the running direction of the wire. Rotatably mounted half-open threaded hollow spindles 13 of the wire shifting rollers 9 and 11 are rotated so that the wire to be pulled in does not touch them. The wire is inserted in the guide grooves exposed thereunder in the cores 12 of the wire shifting rollers 9 and 11 during the first rotation of the band 1. After the first rotation of the band 1, threaded hollow spindles 13 of the wire shifting rollers 9 and 11 perform one full rotation. The wire located in the guide grooves of cores 12 of wire shifting rollers 9 and 11 is therefore grasped by the thread grooves of the two threaded hollow spindles 13. The wire is lifted out of the present guide grooves and shifted axially through the pitch of the thread groove and lowered into the next guide grooves located therebefore in cores 12 of wire shifting rollers 9 and 11. The last guide grooves of cores 12 of the wire shifting rollers 9 and 11 are thus free for the next passage as the wire wound about wire guide roller blocks 2, 3 and 4 changes its position axially by one guide groove interval. This process may be repeated in accordance with the desired number of passages.

The wire pull-in apparatus includes an endless and twist-proof band 1 which is guided over deflection rollers 5, 6, 7 disposed coaxially with respect to the wire deflection roller blocks 2, 3, 4 and arranged behind the last wire passage means as viewed in the axial direction. The band 1 is driven via the deflection roller 7 which is coupled to the driven wire deflection roller block 2. A wire holder 8 for fixing the wire to the band is oriented relative to the band 1 such that the wire fixed thereto is accurately positioned into the last guide grooves of the wire deflection roller blocks 2, 3 during one band revolution. Wire guide roller blocks 12, as viewed in the direction of wire transport, are arranged immediately in front of the wire deflection roller blocks 2, 3 and axially parallel therewith. Each roller block has a guide groove depth corresponding to the wire enamelling plant. Semi-open threaded hollow spindles 13 have a pitch corresponding to twice the distance between two guide grooves at the wire guide roller blocks 12. Contactless proximity switches scan the contact lugs co-rotating together with the threaded hollow spindles 9, 11, control the application of electrical power to the drive motors.

In the starting position, the wire holder 8 is arranged as viewed in direction of wire transport directly following the wire deflection roller block 4. The semi-open threaded hollow spindles 10 are supported in pivotable manner and rotate such that the wire being pulled in does not touch the threaded hollow spindles 10. After the wire is acquired by the wire holder 8, the band 1 is put into revolution by switching on the driven wire deflection roller block 2 and the defection roller 7 coupled thereto, whereby the latter positions the wire pulled behind it in the respectively last grooves of the wire deflection roller blocks 12 and/or encircles, respectively, the wire deflection roller blocks 2, 3, 4 in this position.

After a full revolution of the band, the wire fixation means 8 activates a contactless proximity switch mounted below the driven wire deflector roller block 2, whereby motors rotate the pivotally supported, semi-open threaded hollow spindles 10. By this arrangement, the wire running in the guide grooves of the wire guide roller blocks 12 is caught by the thread grooves, is lifted from the guide grooves and simultaneously axially shifted by the pitch of the thread grooves that the wire will be positioned into the guide groove in front of the wire guide roller blocks 12. Contactless proximity switches are activated by contact lugs arranged at the front face of the threaded hollow spindle 13, and terminate the rotational movement of the drive motors 14 after one rotation. Thereby, the last guide grooves at the wire guide roller blocks 12 become free again as the next wire changes its position at the wire deflection roller blocks 2, 3, 4, so that the operation described above can be repeated in accordance with the desired number of passages.

By linking the various functions, e.g. the fastening of the wire on fastening element 8, the setting to work of band 1 by coupling it with driven wire guide roller block 2, the rotating or axial shifting of wire shifting rollers 9 and 11 after one rotation of the band, one can obtain a fully automatic operation of the wire pull-in apparatus.

The invention is not limited to these embodiment examples. In particular, any desired combinations between the various wire guide roller blocks described, e.g. with or without guide grooves, and the various types of wire shifting rollers described can yield further advantageous variants of the invention.

We claim:

1. A wire pull-in apparatus for use in combination with a wire enamelling facility wherein wire being pulled in is guided in guide grooves formed around spaced, axially parallel wire guide roller blocks thereby defining wire loops around each wire guide roller block, whereby the wire loops disposed around each wire guide roller block are held a predetermined spacing interval apart from each other, characterized in that:

a band roller is mounted for rotation in coaxial alignment with each wire guide roller block, respectively;

a flexible wire guide band is looped around each band roller, the wire guide band including a wire holding means for holding one end of the wire being pulled in; and, a wire shifting roller is mounted adjacent at least one of the wire guide roller blocks, the wire shifting roller being engagable with the lead-in portion of each wire loop for axially shifting each wire loop by one spacing interval before each new wire loop is placed on said at least one wire guide roller block.

2. The wire pull-in apparatus of claim 1, characterized in that the wire holding means comprises a wire fastening portion projecting transversely from the wire guide band.

3. The wire pull-in apparatus of claim 1, characterized in that the wire holding means has a laterally projecting wire fastening portion for depositing a wire in one of the wire guide grooves during a rotation of the wire guide band.

4. The wire pull-in apparatus of claim 1, characterized in that each band roller is coupled to one of the guide roller blocks, respectively, for concurrent rotation therewith.

5. The wire pull-in apparatus of claim 1, characterized in that the wire guide roller blocks have parallel guide grooves spaced a certain equal distance apart on the periphery thereof perpendicular to the axial direction.

6. The wire pull-in apparatus as defined in claim 1, wherein the wire shifting roller comprises an eccentrically mounted, threaded spindle having a thread pitch corresponding to the spacing interval between two adjacent guide grooves on one of the wire guide blocks.

* * * * *